US005592702A

United States Patent [19]

Gillebaard, Jr.

[11] Patent Number: 5,592,702

[45] Date of Patent: Jan. 14, 1997

[54] VARIABLE SIZE ABOVE-GROUND SWIMMING POOL

[76] Inventor: Hendrik C. Gillebaard, Jr., 1015 Calle Amanecer, San Clemente, Calif. 92673

[21] Appl. No.: 433,256

[22] Filed: Apr. 28, 1995

[51] Int. Cl.[6] ..... E04H 4/00; A47K 3/06

[52] U.S. Cl. ..... 4/506; 4/585

[58] Field of Search ..... 4/506, 585

[56] References Cited

U.S. PATENT DOCUMENTS

| | | | |
|---|---|---|---|
| 1,664,887 | 4/1928 | Kirkham et al. | 4/506 X |
| 2,378,159 | 6/1945 | Royer | 220/9.1 X |
| 3,191,190 | 6/1965 | Lowry | 4/585 |
| 3,225,362 | 12/1965 | Barrera | 4/506 X |
| 3,443,263 | 5/1969 | Minasy | 52/245 |
| 3,660,853 | 5/1972 | Ducrocq et al. | 4/506 |
| 4,356,933 | 11/1982 | Connolly | 220/401 |
| 4,597,113 | 7/1986 | Eymard | 4/488 |
| 4,890,343 | 1/1990 | Schlags | 4/585 |
| 4,989,751 | 2/1991 | Gillett | 220/565 |
| 5,083,327 | 1/1992 | Gillebaard | 4/506 |

FOREIGN PATENT DOCUMENTS

| | | | |
|---|---|---|---|
| 1123409 | 9/1956 | France | 4/506 |
| 478106 | 8/1975 | U.S.S.R. | 4/506 |
| 0001729 | 10/1876 | United Kingdom | 4/585 |
| 0767621 | 2/1957 | United Kingdom | 4/506 |
| 1037127 | 7/1966 | United Kingdom | 4/506 |

*Primary Examiner*—Robert M. Fetsuga
*Attorney, Agent, or Firm*—Stetina Brunda & Buyan

[57] ABSTRACT

A variable size, portable above-the-ground swimming pool comprising a frame portion having a flexible liner portion attached thereto. The frame portion includes a plurality of first wall members which are of a first length. Attached to and extending between the top ends of the first wall members are a plurality of rim members. The liner portion includes an upper rim which defines a plurality of horizontally oriented rim sleeves sized to slidably receive respective ones of the rim members. Extending downwardly from the upper rim is a sidewall which defines inner and outer surfaces. Disposed on the outer surface of the sidewall are a plurality of vertically oriented wall sleeves which are sized to slidably receive respective ones of the first wall members, while attached to the sidewall is a floor. The sidewall is of a first height, and is selectively collapsible to a second height which is less than the first height. Additionally, the first wall members are selectively replaceable with a plurality of second wall members which are of a second length less than the first length for purposes of reducing the size of the pool when the sidewall is collapsed to the second height.

4 Claims, 2 Drawing Sheets

VARIABLE SIZE ABOVE-GROUND SWIMMING POOL

FIELD OF THE INVENTION

The present invention relates generally to above-ground swimming pools and more particularly to portable swimming pools and those of variable size, i.e., the height of the wall of the swimming pool is adjustable.

BACKGROUND OF THE INVENTION

Above-the-ground swimming pools currently available, that claim to be capable of assembly and disassembly, are commonly comprised of sheet metal panels. Alternatively, portable swimming pool structures comprised of an air-filled pontoon are available. Although such products have proven generally suitable for their intended purposes, they possess inherent deficiencies which detract from their overall effectiveness. Sheet metal panels are heavy to move around, time consuming to assemble and subject to corrosion. Air filled pontoons are subject to rupture and leakage.

In addition, even if a small pool lasts a long time and is reusable season after season, children grow up and consequently the pool tends to outlive its usefulness. If parents buy a larger pool to start with, there is a greater danger of drowning since the pool may still contain water to a greater depth. The higher sidewalls of a larger pool could also prevent a smaller child from egressing from the pool.

SUMMARY OF THE INVENTION

In view of the shortcomings of the prior art it is the object of this invention to provide a portable above-the-ground swimming pool that is of variable size, i.e., the height of the sidewall is adjustable dependent upon the ages of the children using the pool.

The present invention specifically addresses and alleviates the above mentioned deficiencies associated with the prior art. Applicant incorporates by reference the disclosure from his prior invention Gillebaard, U.S. Pat. No. 5,083,327 (issued Jan. 28, 1992). In that invention Applicant teaches a truly portable above-the-ground swimming pool. Here Applicant adds the advantage of variable-size sidewalls. The invention includes a frame portion that is readily assembled and disassembled, and of varying height. The invention also includes a liner portion that can be partially folded in on itself. A variable size pool is the result.

Features of the present invention include a frame portion including rim members and wall members interconnected together. Included among the wall members are multiple sets of varying lengths. The flexible liner portion includes an upper rim, a sidewall, a floor, and various sleeves in the sidewall that receive the frame portions. A preferred embodiment includes a belt that goes around the outside of the sidewall for structural support. The preferred embodiment further includes inner loops located on the inner side of the sidewalls, which connect together to capture excess liner material when the smaller-sized pool is set up. The preferred embodiment also includes multiple sets of outer loops located on the outside surface of the sidewalls, to receive at varying levels the belt that goes around the perimeter of the sidewalls, and outer straps connect the outer loops together and secure the belt.

The advantages of the present invention, namely true portability and the ability to vary the size of the swimming pool, are provided by the above-mentioned features. The variable size pool operates as follows. Upon adjusting the size of the frame of the pool to a lesser height, the liner is folded in on itself, and the inner loops are connected together to capture the excess liner material. The belt is relocated to a higher set of outer loops on the sidewall, and the outer straps connected.

These as well as other advantages of the present invention will be more apparent from the following description and drawings. It is understood that changes in the specific structure shown and described may be within the scope of the claims without departing from the spirit of the invention.

DETAILED DESCRIPTION OF THE PREFERRED EMBODIMENT

The detailed discussion set forth below in connection with the appended drawings is intended as a description of embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The variable size, portable above-the-ground swimming pool of the present invention is illustrated in FIGS. 1–6 which depict a presently preferred embodiment of the invention. Applicant incorporates by reference the disclosure from his prior invention, Gillebaard, U.S. Pat. No. 5,083,327 (issued Jan. 28, 1992). The variable-size pool assembly 70 is generally comprised of a portable pool assembly 10 which includes a frame portion 12, and a flexible liner portion 14.

Figure 1:
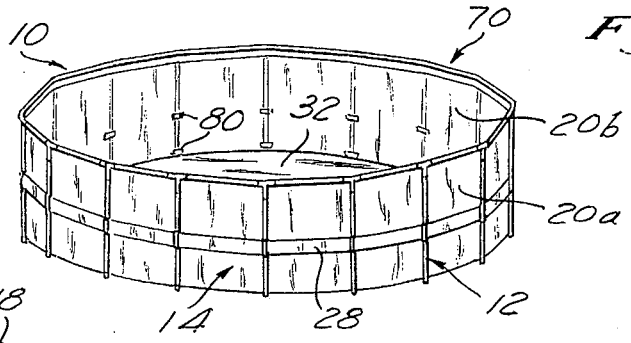
FIG. 1 is a perspective view of the variable size, portable above-ground swimming pool of the present invention.
Figure 2:
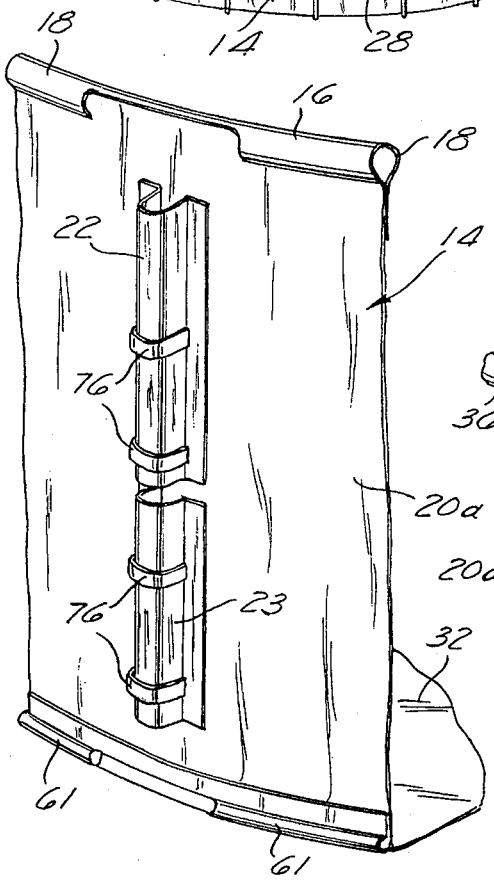
FIG. 2 is a perspective view of the flexible liner portion of the invention.
Figure 3:
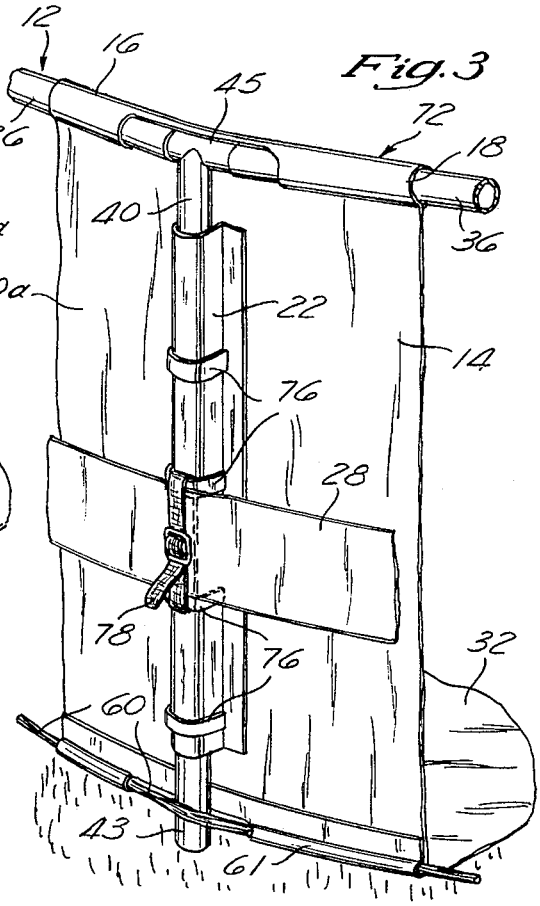
FIG. 3 is a perspective view of the frame portion, with the liner portion mounted thereon, of the invention.

Referring now to FIGS. 1–3, the preferred embodiment is described for a variable size swimming pool having a sixteen-foot diameter. Proportionally fewer frame members and sleeves would be required for a small swimming pool, e.g., having a twelve-foot diameter. The frame portion 12 includes a first set of sixteen wall members 40, each having a top end 41 and a bottom end 43, and being about four feet in length. A set of sixteen rim members 36 are used to form the top perimeter of the pool 10 by connecting together the top ends 41 of the wall members 40. Sixteen joint members 45 may be used to make the structural connections between rim members 36 and wall members 40. All the members of the frame portion 12 are preferably constructed from PVC tubing.

The flexible liner portion 14 includes an upper rim 16 which is made up of sixteen horizontally disposed rim sleeves 18 which are sized to accept the rim members 36. A sidewall 20 extends down from the upper rim 16, the sidewall 20 having an inner, water-contacting surface 20*b*and an outer surface 20*a*. Attached to the outside surface 20*a* of the sidewalls 20, approximately every 20 degrees around the perimeter of the sidewalls 20, are a pair of wall sleeves 22 and 23. The wall sleeves 22 and 23 are split into a pair for reasons that will become clear later in this discussion. The wall sleeves 22 and 23 are sized to receive the wall members 40. Finally, the flexible liner portion 20, includes a floor portion 32, the perimeter of the floor portion 32 connected to the sidewall 20. A reinforcement member (not shown) may be added to strengthen the connection between the sidewall 20 and the floor portion 32. Attached to each of the wall sleeves 22 and 23, are a pair of outer loops 76. A large belt 28 is installed around the perimeter of the pool 10, at about the mid-level of the wall members 40, to provide additional structural support. The belt 28 is installed between a pair of the outer loop members 76 and it is held in place by an outer strap 78. The belt 28 is preferably constructed from tri-ply PVC. The remainder of the flexible liner portion 14 is preferably constructed of a polyester material with the inner surface 20*b* coated with waterproof vinyl.

Figure 4:
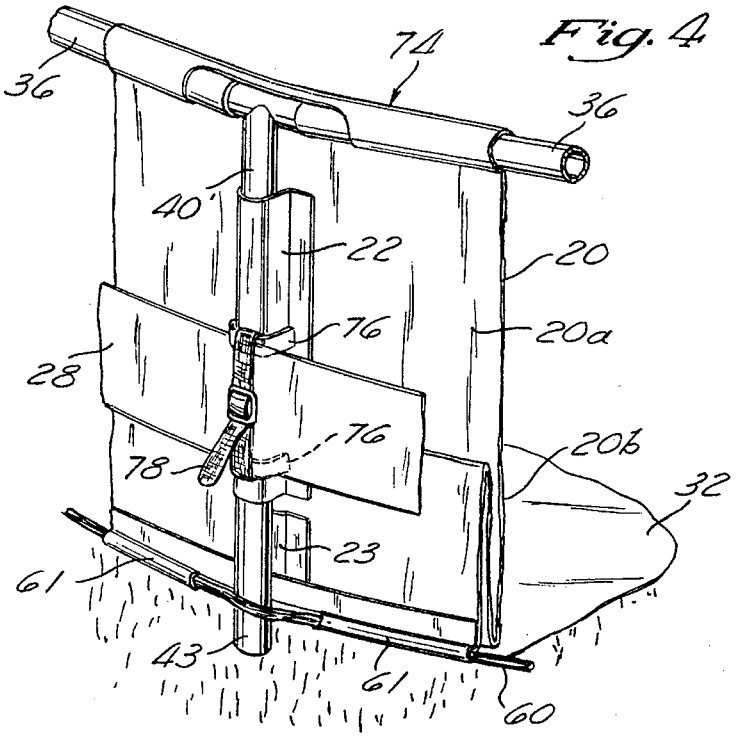
FIG. 4 iS a perspective view of the frame and liner portions set up for a smaller sized pool.

Now referring to FIGS. 3 and 4 the variable size advantage of the invention may be described in terms of the features which provide the variable size capability. FIG. 3 shows the variable size pool 70 set up as a larger sized pool 72. A cord 60 at the lower edge of the sidewall 20, the interface to the floor portion 32, supports the connection between the sidewall 20 and the floor portion 32. The sidewall 20 further includes sixteen horizontally disposed cord sleeves 61 which are sized to accept the cord 60. The first set of wall members 40', approximately four feet in length, are installed in the frame portion 12.

FIG. 4 shows the variable sized pool set up as a smaller sized pool 74. A second set of wall members 40', approximately two feet in length, have been substituted for the first set of wall members 40. The flexible liner sidewall 20 has been folded up inside the pool perimeter. The cord 60 remains adjacent the floor portion 32. The belt 28 has been relocated upward to between the next set of outer loops 76, and is again secured by the outer strap 78.

Figure 5:
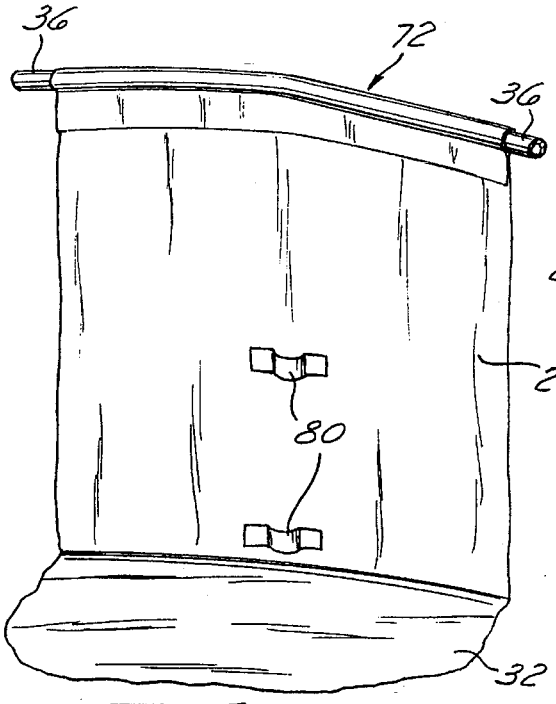
FIG. 5 is a perspective view from inside the pool showing the inner loop members of the liner portion, set up for a larger sized pool.
Figure 6:
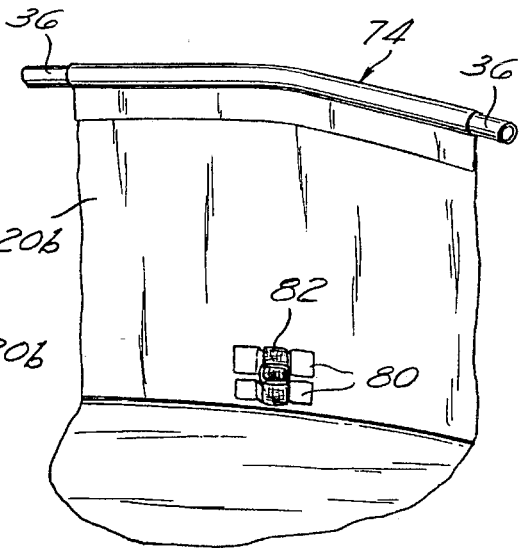
FIG. 6 is a perspective view from inside the pool showing the liner portion set up for a smaller sized pool.

FIGS. 5 and 6 show another feature of the preferred embodiment. Attached around the inner surface 20*b* of the flexible liner portion 20 are sixteen pairs of inner loop members 80. The inner loop members 80 are installed every twenty degrees around the inner surface 20*b*, at approximately the same locations that the wall sleeves 22 and 23 are attached to the outside surface 20*a* of the flexible liner sidewall 20. FIG. 5 shows the larger sized pool 72, and the inner loop members 80 are spaced apart and non-functional.

FIG. 6 shows the smaller sized pool 74. Upon folding of the flexible liner sidewall 20 in upon itself as depicted in FIG. 4, the inner loop members 80 are now located immediately adjacent to each other. An inner strap 82 is used to connect the inner loop members 80 to each other. The folded sidewall 20 is captured by the inner loop members 80 tied together by the inner strap 82, and the excess sidewall 20 is held in place.

It is well understood that the exemplary variable size above-the-ground swimming pool described herein and shown in the drawings represents only a present preferred embodiment and an alternative embodiment of the invention. Indeed, various modifications and additions may be made to such embodiments without departing from the spirit and scope of the invention. By way of example only, telescopic wall members 40 could be provided, having an upper segment and a lower segment of differing diameters, such that the segments slidably receive each other, and a coupling to lock their relative position to each other. Thus, these and other modifications and additions may be obvious to those skilled in the art and may be implemented to adapt the present invention for use in a variety of applications.

What is claimed is:

1. A variable size, portable above-the-ground swimming pool, comprising:

a frame portion including:

a plurality of wall members having top and bottom ends; and a plurality of rim members attached to and extending between the top ends of the wall members;

a flexible liner portion including:

an upper rim defining a plurality of horizontally oriented rim sleeves sized to slidably receive respective ones of the rim members;

a sidewall extending downwardly from the upper rim and defining an inner, water contacting surface and an outer surface, said sidewall being of a first height and selectively collapsible to a second height which is less than the first height;

a plurality of vertically oriented wall sleeves disposed on the outer surface of the sidewall and sized to slidably receive respective ones of the wall members;

a plurality of inner loop members disposed on the inner surface of the sidewall in vertically oriented pairs, the inner loop members of each pair being separated from each other by a first distance, with the collapse of the sidewall to the second height reducing the distance separating the inner loop members of each pair to a second distance which is less than the first distance, said sidewall being maintained in the collapsed configuration by the connection of the inner loop members of each pair to each other; and a floor attached to said sidewall.

2. A variable size, portable above-the-ground swimming pool, comprising:

a frame portion including:

a plurality of wall members having top and bottom ends; and a plurality of rim members attached to and extending between the top ends of the wall members;

a flexible liner portion including:

an upper rim defining a plurality of horizontally oriented rim sleeves sized to slidably receive respective ones of the rim members;

a sidewall extending downwardly from the upper rim and defining an inner, water contacting surface and an outer surface, said sidewall being of a first height and selectively collapsible to a second height which is less than the first height;

a plurality of vertically oriented wall sleeves disposed on the outer surface of the sidewall and sized to slidably receive respective ones of the first wall members;

a plurality of outer loop members disposed on respective ones of said wall sleeves in spaced relation to each other; and a floor attached to said sidewall;

a belt extending between said outer loop members about the outer surface of the sidewall to provide structural support to the frame portion, said plurality of outer loop members including a first pair on each wall sleeve being used to facilitate the attachment of said belt to said liner portion when the sidewall is at the first height, and a second pair on each wall sleeve being used to facilitate the attachment of said belt to said liner portion when the sidewall is collapsed to the second height.

3. A variable size, portable above-the-ground swimming pool, comprising:

a frame portion including:

a plurality of first wall members having top and bottom ends, said first wall members being of a first length; and a plurality of rim members attached to and extending between the top ends of the first wall members;

a flexible liner portion including:

an upper rim defining a plurality of horizontally oriented rim sleeves sized to slidably receive respective ones of the rim members;

a sidewall extending downwardly from the upper rim and defining an inner, water contacting surface and an outer surface, said sidewall being of a first height and selectively collapsible to a second height which is less than the first height;

a plurality of vertically oriented wall sleeves disposed on the outer surface of the sidewall and sized to slidably receive respective ones of the first wall members;

a plurality of inner loop members disposed on the inner surface of the sidewall in vertically oriented pairs, the inner loop members of each pair being separated from each other by a first distance, with the collapse of the sidewall to the second height reducing the distance separating the inner loop members of each pair to a second distance which is less than the first distance, said sidewall being maintained in the collapsed configuration by the connection of the inner loop members of each pair to each other; and a floor attached to said sidewall;

a plurality of second wall members of a second length which is less than the first length, said first wall members being selectively replaceable with the second wall members when the sidewall is collapsed to the second height for purposes of reducing the size of the pool.

4. The pool of claim 3 wherein said liner portion further includes a lower rim defining a plurality of horizontally oriented cord sleeves, and said pool further includes a cord extending through said cord sleeves about the outer surface of the sidewall adjacent the floor.

* * * * *